US011226574B1

(12) United States Patent
Kouzu

(10) Patent No.: US 11,226,574 B1
(45) Date of Patent: Jan. 18, 2022

(54) IMAGE FORMING APPARATUS

(71) Applicant: TOSHIBA TEC KABUSHIKI KAISHA, Tokyo (JP)

(72) Inventor: Norio Kouzu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/117,313

(22) Filed: Dec. 10, 2020

(51) Int. Cl.
*G03G 15/16* (2006.01)
*G03G 21/16* (2006.01)
*G03G 15/01* (2006.01)

(52) U.S. Cl.
CPC ..... *G03G 15/165* (2013.01); *G03G 15/0131* (2013.01); *G03G 15/0189* (2013.01); *G03G 15/161* (2013.01); *G03G 21/168* (2013.01); *G03G 15/16* (2013.01); *G03G 2215/00139* (2013.01); *G03G 2215/0193* (2013.01); *G03G 2221/1642* (2013.01)

(58) Field of Classification Search
CPC ..... G03G 15/0131; G03G 15/0189; G03G 15/161; G03G 15/165; G03G 21/168; G03G 2215/00139; G03G 2221/1642
See application file for complete search history.

(56) References Cited

U.S. PATENT DOCUMENTS 10,175,615 B1 * 1/2019 Kouzu ..... G03G 15/1685
2016/0139552 A1 5/2016 Eda et al.

FOREIGN PATENT DOCUMENTS

EP 0584928 A2 * 3/1994 ..... G03G 15/165
JP 05-333613 12/1993
JP 2018146849 A * 9/2018 ..... G03G 15/6555

* cited by examiner

*Primary Examiner* — Joseph S Wong
(74) *Attorney, Agent, or Firm* — Amin, Turocy & Watson, LLP

(57) ABSTRACT

An image forming apparatus includes an main body, a processing unit, and a pressing member. The main body includes a transfer belt wound around a plurality of rollers. The processing unit can be inserted into and removed from the main body. The processing unit includes a drum that faces the transfer belt in a state of being inserted into the main body. The processing unit forms an image on the surface of the drum. The pressing member is provided on the main body and includes a contacted portion and a contacting portion. The contacted portion comes into contact with the processing unit when the processing unit is inserted into and removed from the main body. The contacting portion comes contact with the transfer belt due to contact with the processing unit to push the transfer belt in a direction away from the processing unit.

20 Claims, 7 Drawing Sheets

IMAGE FORMING APPARATUS

FIELD

Embodiments described herein relate generally to an image forming apparatus such as a copying machine, a printer, and a multi-functional peripheral.

BACKGROUND

When replacing the processing unit of the image forming apparatus, the transfer belt is separated from the processing unit, the old processing unit is removed from the apparatus main body, and a new processing unit is inserted into the apparatus main body. Here, in order to bring the transfer belt out of contact with the processing unit, one or more of the rollers around the transfer belt are moved in a direction away from the processing unit.

However, if the transfer belt is elongated due to aging, it may not be possible to separate the transfer belt from the processing unit even if the roller around the transfer belt is moved. Here, when the processing unit is attached to or detached from the apparatus main body, the processing unit may come into contact with the transfer belt and damage the transfer belt.

In order to prevent such a problem, it is conceivable to increase the amount of movement of the roller around the transfer belt or increase the load of the tension spring that gives tension to the transfer belt. However, if the amount of movement of the roller around the transfer belt is increased, the movement mechanism becomes large. If the load of the tension spring is increased, the elongation of the transfer belt is increased.

Therefore, it is desired to develop an image forming apparatus capable of avoiding contact with the transfer belt of the processing unit when the processing unit is inserted and removed from the apparatus main body by a simple configuration.

DETAILED DESCRIPTION

In general, according to one embodiment, the image forming apparatus includes an apparatus main body, a processing unit, and a pressing member. The apparatus main body includes a transfer belt wound around a plurality of rollers in an endless manner. The processing unit is provided so that the processing unit can be inserted into and removed from the apparatus main body. The processing unit includes a photosensitive drum that faces the transfer belt in a state of being inserted into the apparatus main body. The processing unit forms an image on the surface of the photosensitive drum. The pressing member is provided on the apparatus main body and includes a contacted portion and a contacting portion. The contacted portion comes into contact with the processing unit when the processing unit is inserted into and removed from the apparatus main body. The contacting portion comes contact with the transfer belt due to contact with the processing unit to push the transfer belt in a direction away from the processing unit.

Hereinafter, an image forming apparatus 1 according to the embodiment will be described with reference to the drawings.

Figure 1:
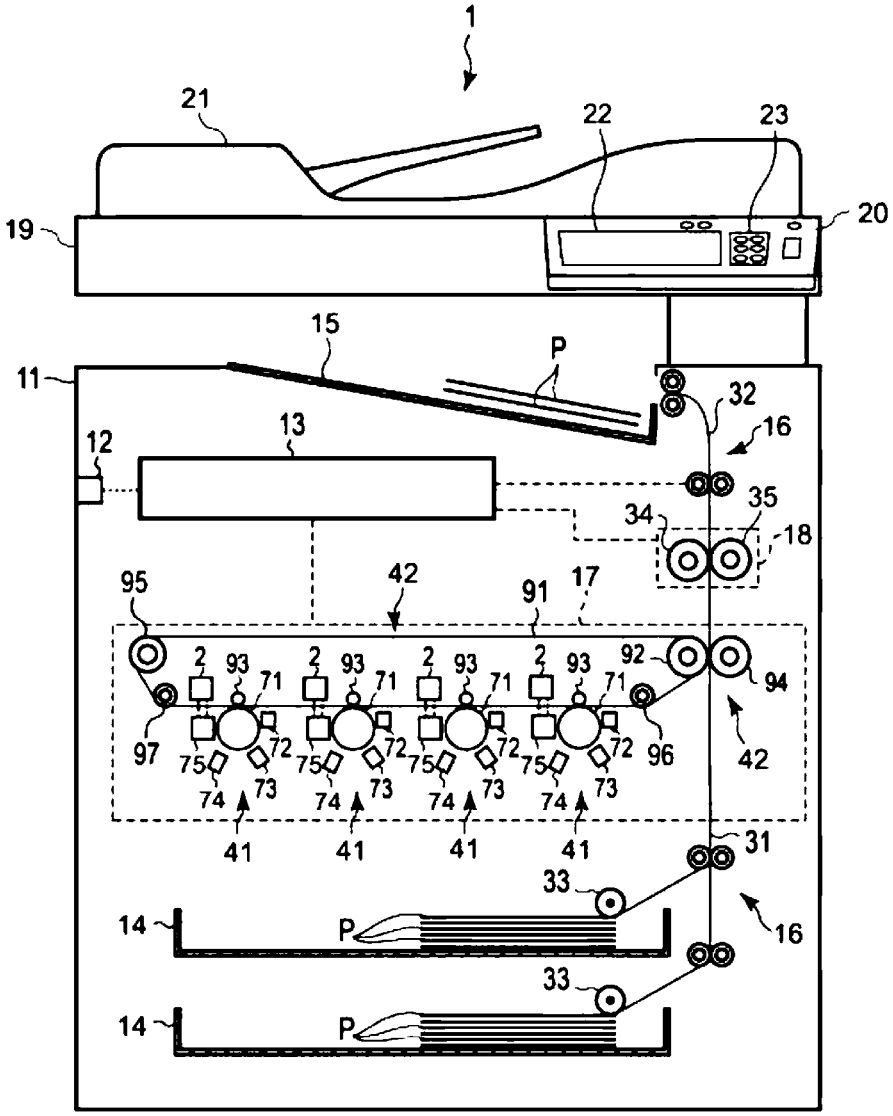
FIG. 1 is a schematic view of an image forming apparatus according to an embodiment.

As shown in FIG. 1, the image forming apparatus 1 includes a housing 11. The housing 11 includes a communication interface 12, a system controller 13, a plurality of sheet trays 14, a sheet discharge tray 15, a conveyance unit 16, an image forming unit 17, a fixing unit 18, a scanner unit 19, and a control panel 20. The housing 11 is the main body of the image forming apparatus 1. In the following description, in FIG. 1, the front side of the paper surface is the front side of the image forming apparatus 1, and the opposite side is the rear side. The top, bottom, left, and right of the image forming apparatus 1 are defined when the image forming apparatus 1 is viewed from the front side.

The communication interface 12 is an interface for communicating with other devices. The communication interface 12 is used, for example, for communication with an upper device. The upper device is also referred to as an external device. The communication interface 12 is constituted of, for example, a LAN connector or the like. The communication interface 12 may perform wireless communication with other devices according to a standard such as Bluetooth (registered trademark) or Wi-Fi (registered trademark).

The system controller 13 functions as a control unit of the image forming apparatus 1. The system controller 13 is connected to the communication interface 12. The system controller 13 generates a print job based on, for example, data acquired from an external device via the communication interface 12. The print job includes image data formed on a print medium P. The image data may be data for forming an image on one print medium P or may be data for forming an image on a plurality of print media P. The print job may include information indicating whether the job is a color print or a monochrome print.

The system controller 13 that generated the print job controls the operations of the transport unit 16, the image forming unit 17, and the fixing unit 18, and forms an image of the image data included in the print job on the print medium P. Specifically, the system controller 13 controls the conveyance of the print medium P by the conveyance unit 16, the image formation on the print medium P by the image forming unit 17, and the fixing of the image on the print medium P by the fixing unit 18. As described above, the system controller 13 also has a function as an engine controller of the image forming apparatus 1.

The image forming apparatus 1 may be configured to include an engine controller separately from the system controller 13. Here, the engine controller controls at least one of the conveyance of the print medium P by the conveyance unit 16, the image formation on the print medium P by the image forming unit 17, the fixing of the image on the print medium P by the fixing unit 18, and the like. The system controller 13 supplies the engine controller with information necessary for control in the engine controller.

The plurality of sheet trays 14 are cassettes each accommodating the print medium P. The sheet tray 14 is configured so that the print medium P can be supplied from the outside of the housing 11. For example, the sheet tray 14 is configured to be retractable from the housing 11.

The sheet discharge tray 15 is a tray that receives the print medium P discharged from the image forming apparatus 1.

The conveyance unit 16 is a mechanism for conveying the print medium P in the image forming apparatus 1. As shown in FIG. 1, the conveyance unit 16 includes a plurality of conveyance paths. For example, the conveyance unit 16 includes a sheet feed conveyance path 31 and a sheet discharge conveyance path 32.

The sheet feed conveyance path 31 and the sheet discharge conveyance path 32 are configured of a plurality of rollers, a plurality of guides (not shown), and the like. The plurality of rollers convey the print medium P by rotating by the power transmitted from the drive mechanism. The plurality of guides control the conveying direction of the print medium P conveyed by the rollers.

The sheet feed conveyance path 31 picks up the print medium P from the sheet tray 14 and supplies the picked-up print medium P to the image forming unit 17. The sheet feed conveyance path 31 includes a plurality of pickup rollers 33 corresponding to each sheet tray 14. Each pickup roller 33 picks up the print medium P of the sheet tray 14 into the sheet feed conveyance path 31.

The sheet discharge conveyance path 32 is a conveyance path for discharging the print medium P on which the image is formed by the image forming unit 17 from the housing 11. The print medium P discharged by the sheet discharge conveyance path 32 is supported by the sheet discharge tray 15.

The image forming unit 17 has a configuration for forming an image on the print medium P. The details of the image forming unit 17 will be described later.

The fixing unit 18 includes a heat roller 34 and a pressure roller 35. The fixing unit 18 heats the print medium P conveyed through the sheet discharge conveyance path 32 at a predetermined temperature by the heat roller 34 and further pressurizes the print medium P by the pressure roller 35, thereby fixing the toner image transferred to the print medium P onto the print medium P.

The scanner unit 19 is a device that reads a document and converts the read document into image data and is installed on the upper part of the housing 11. The scanner unit 19 includes an automatic document feeder 21. The scanner unit 19 reads the document conveyed by the automatic document feeder 21.

The control panel 20 includes a touch panel 22, a keyboard 23, and the like. The touch panel 22 is a stack of a display such as a liquid crystal display or an organic EL display and a pointing device for detecting touch input. As information to be notified to the user of the image forming apparatus 1, for example, an image for setting various functions of the image forming apparatus 1 is displayed on the display.

The keyboard 23 includes various keys for the user of the image forming apparatus 1 to operate. For example, the keyboard 23 includes a numeric keypad, a power key, a sheet feed key, a function key, and the like. Each key may be referred to as a button. As such, the touch panel 22 and the keyboard 23 function as input devices for the image forming apparatus 1. The display included in the touch panel 22 functions as a display device of the image forming apparatus 1.

Next, the image forming unit 17 will be described.

Figure 2:
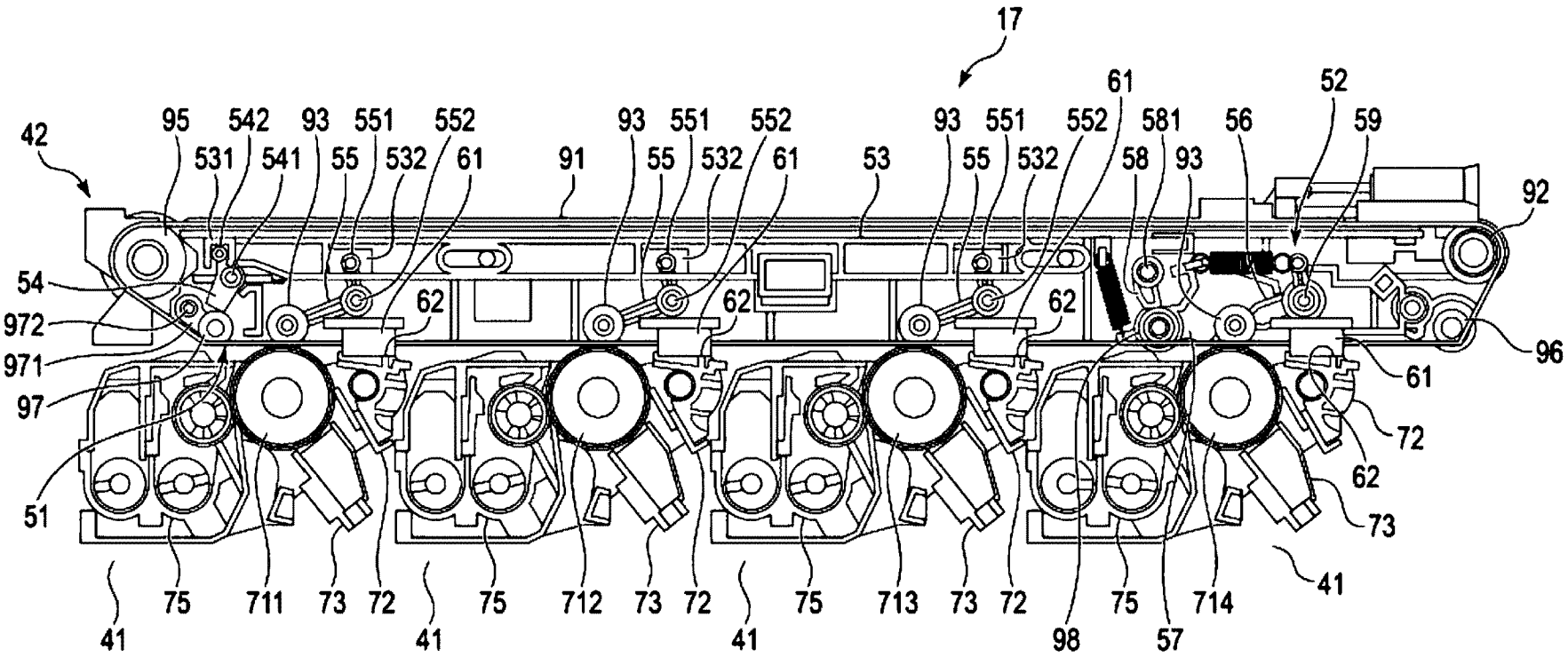
FIG. 2 is an enlarged view showing an image forming unit.

As shown in FIGS. 1 and 2, the image forming unit 17 includes a plurality of (four in this embodiment) processing units 41 and a transfer unit 42. The plurality of processing units 41 are provided side by side in the traveling direction of a transfer belt 91, which will be described later, below the drawing of the transfer unit 42.

The plurality of processing units 41 are units for forming toner images of a color. A plurality of processing units 41 are provided for each type of toner. For example, the plurality of processing units 41 correspond to toner of colors such as cyan, magenta, yellow, and black, respectively. Each processing unit 41 includes a toner cartridge 2 having a toner of a corresponding color.

The plurality of toner cartridges 2 provided for a color and the plurality of processing units 41 have the same configuration. Therefore, here, only the configuration for one color will be described as a representative by assigning the same reference numerals to the same configuration. In FIG. 2, an exposure device 74 of the processing unit 41 is not shown.

The toner cartridge 2 is a container for storing toner. The toner contained in the toner cartridge 2 is supplied to a developing device 75. The processing unit 41 includes a photosensitive drum 71 (photosensitive drums 711, 712, 713, and 714 in FIG. 2), a cleaner 72, a charging unit 73, the exposure device 74, and the developing device 75.

The photosensitive drum 71 (711, 712, 713, and 714) is a photoconductor including a cylindrical drum and a photosensitive layer formed on the outer peripheral surface of the drum. The photosensitive drum 71 is rotated in the clockwise direction in the drawing at a constant speed by the power transmitted from the drive mechanism.

The cleaner 72 includes a blade that comes into contact with the surface of the photosensitive drum 71. The cleaner 72 uses the blade to remove the toner remaining on the surface of the photosensitive drum 71.

The charging unit 73 uniformly charges the surface of the photosensitive drum 71. For example, the charging unit 73 charges the photosensitive drum 71 to a uniform negative potential by applying a grid bias voltage output from the grid electrodes to the photosensitive drum 71. Such a charging unit 73 is also referred to as a charger.

The exposure device 74 includes a plurality of light emitting elements. The light emitting element is, for example, a laser diode (LD), a light emitting diode (LED), an organic EL (OLED), or the like. The plurality of light emitting elements are aligned in the main scanning direction, which is a direction parallel to the rotation axis of the photosensitive drum 71. Each light emitting element is configured to irradiate one point on the photosensitive drum 71 with light.

The exposure device 74 forms a latent image for one line on the photosensitive drum 71 by irradiating the surface of the charged photosensitive drum 71 with the light from the plurality of light emitting elements aligned in the main scanning direction. The exposure device 74 continuously irradiates the surface of the rotating photosensitive drum 71 with light to form a plurality of lines of latent images on the surface of the photosensitive drum 71.

The developing device 75 adheres the toner to the photosensitive drum 71. The developing device 75 contains a developer containing toner and carriers. The developing device 75 receives the toner delivered from the toner cartridge 2.

The processing unit 41 operates as follows.

When the surface of the photosensitive drum 71 charged by the charging unit 73 is irradiated with the light from the exposure device 74, a latent image is formed. Next, the toner contained in the developer supplied from the developing device 75 adheres to the latent image formed on the surface of the photosensitive drum 71. As a result, a toner image is formed on the surface of the photosensitive drum 71.

The transfer unit 42 transfers the toner image formed on the surface of the photosensitive drum 71 to the print medium P. The transfer unit 42 includes, for example, transfer belt 91, a drive roller 92, a plurality of primary transfer rollers 93, a secondary transfer roller 94 (not shown in FIG. 2), a tension roller 95, a driven roller 96, a belt moving roller 97, and a belt pressing roller 98.

The transfer belt 91 is wound around the drive roller 92 in an endless manner, the tension roller 95, the driven roller 96, the belt moving roller 97, and the belt pressing roller 98. The inner surface (inner peripheral surface) of the transfer belt 91 contacts the plurality of rollers 92, 95, 96, 97, and 98. The outer surface (outer peripheral surface) of the transfer belt 91 faces the photosensitive drums 71 of the plurality of processing units 41 and the secondary transfer roller 94.

The drive roller 92 is rotated by the power transmitted from a drive mechanism (not shown here). The drive roller 92 rotates to cause the transfer belt 91 to travel in a predetermined direction (counterclockwise in FIG. 2). The plurality of rollers 92, 95, 96, 97, and 98 around which the transfer belt 91 is wound are configured to be freely rotatable and rotate according to the traveling of the transfer belt 91 by the drive roller 92.

The tension roller 95 is biased in the direction of pushing the transfer belt 91 outward by a spring or the like (not shown). The tension roller 95 applies tension to the transfer belt 91 by pushing the transfer belt 91 from the inside to the outside.

The belt moving roller 97 is arranged between the primary transfer roller 93 and the tension roller 95 facing the processing unit 41 for cyan on the leftmost side in FIG. 2. The belt moving roller 97 is interlocked with the primary transfer roller 93 of the three processing units 41 except for the black one.

The belt moving roller 97 is configured to be movable between the position where the transfer belt 91 is brought into contact with the photosensitive drums 711, 712, and 713 of the three processing units 41 except for the black one, and the position where the transfer belt 91 is separated from these photosensitive drums 711, 712, and 713.

The belt pressing roller 98 is located upstream (the left side of FIG. 2) of the primary transfer roller 93 facing the photosensitive drum 714 of the black processing unit 41 (first processing unit) on the rightmost side in FIG. 2 in the traveling direction of the transfer belt 91. The belt pressing roller 98 is configured to be movable between a position where the transfer belt 91 is brought into contact with the black photosensitive drum 714 and a position where the transfer belt 91 is separated from the photosensitive drum 714.

A plurality of primary transfer rollers 93 are provided for each processing unit 41. The plurality of primary transfer rollers 93 are provided to face the photosensitive drums 71 (711, 712, 713, and 714) of the corresponding processing units 41, respectively. Specifically, the plurality of primary transfer rollers 93 are provided at positions facing each other with the photosensitive drum 71 of the corresponding processing unit 41 and the transfer belt 91 interposed therebetween.

The primary transfer roller 93 comes into contact with the inner peripheral surface side of the transfer belt 91 and displaces the transfer belt 91 toward the photosensitive drum 71. Due to the displacement, the outer peripheral surface of the transfer belt 91 comes into contact with the photosensitive drum 71.

The secondary transfer roller 94 (FIG. 1) is provided at a position facing the drive roller 92 with the transfer belt 91 interposed therebetween. The secondary transfer roller 94 contacts the outer peripheral surface of the transfer belt 91 traveling along the peripheral surface of the drive roller 92, and applies pressure to the outer peripheral surface of the transfer belt 91. By the contact and pressurization, the secondary transfer roller 94 and the outer peripheral surface of the transfer belt 91 are brought into close contact with each other and a transfer nip is formed therebetween.

The secondary transfer roller 94 and the drive roller 92 rotate to convey the print medium P supplied from the sheet feed conveyance path 31 in a state of sandwiching the print medium P. As a result, the print medium P passes through the transfer nip. The secondary transfer roller 94 presses the print medium P passing through the transfer nip against the outer peripheral surface of the transfer belt 91.

In the transfer unit 42 having the above configuration, when the outer peripheral surface of the transfer belt 91 comes into contact with the photosensitive drum 71, the toner image formed on the surface of the photosensitive drum 71 is transferred to the outer peripheral surface of the transfer belt 91. As shown in FIGS. 1 and 2, when the image forming unit 17 includes the plurality of processing units 41, the transfer belt 91 receives the toner images from the photosensitive drums 71 of the plurality of processing units 41. The toner image transferred to the outer peripheral surface of the transfer belt 91 is conveyed to the transfer nip by the transfer belt 91. Here, if the print medium P is present in the transfer nip, the toner image transferred to the outer peripheral surface of the transfer belt 91 is transferred to the print medium P in the transfer nip.

Here, the moving mechanism of the transfer belt 91 will be described.

For example, in order to replace the processing unit 41, the image forming apparatus 1 has a structure in which the processing unit 41 can be inserted into and removed from the housing 11. The processing unit 41 is inserted into and removed from the front side of the housing 11 (the front side of the paper in FIGS. 1 and 2). The processing unit 41 may be capable of separately inserting and removing the developing device 75 and a unit having other configurations into and from the housing 11. The image forming apparatus 1 of the present embodiment has a structure in which the processing unit 41 including the developing device 75 can be inserted into and removed from the front side of the housing 11.

When inserting and removing the processing unit 41 into and from the housing 11, it is necessary to move the transfer belt 91 in a direction away from the processing unit 41 so that the processing unit 41 does not contact the transfer belt 91. The image forming apparatus 1 moves the transfer belt 91 according to its operation mode.

For example, in the color mode for forming a color image, as shown in FIGS. 1 and 2, the transfer belt 91 is moved to a position where the transfer belt 91 is in contact with the photosensitive drums 711, 712, 713, and 714 of all four processing units 41. In the monochrome mode for forming a monochrome image, the transfer belt 91 is moved to a position where the transfer belt 91 is separated from the photosensitive drums 711, 712, and 713 other than the black photosensitive drum 714. During maintenance for inserting and removing the processing unit 41 into and from the housing 11, the transfer belt 91 is moved to a position where the transfer belt 91 is separated from all the photosensitive drums 711, 712, 713, and 714.

As shown in FIG. 2, the moving mechanism of the transfer belt 91 includes a moving mechanism 51 that interlocks three primary transfer rollers 93 other than that for black with the belt moving roller 97, and a moving mechanism 52 that interlocks the primary transfer roller 93 for black with the belt pressing roller 98. The moving mechanisms 51 and 52 may be provided on both the front side and the rear side of the image forming apparatus 1 or may be provided on one side.

The moving mechanism 51 includes a slider 53 that is provided to be movable in the left-right direction of FIG. 2 with respect to the housing 11 of the image forming apparatus 1 and a rotating arm 54 that acts on the belt moving roller 97. The slider 53 is a connected metal frame or the like arranged above the three processing units 41 other than that for black.

The belt moving roller 97 is rotatably attached to the tip of a support arm 971. The base end portion of the support arm 971 is attached to be swingable to the housing 11 via a shaft 972. The rotating arm 54 has an acting end portion that acts on the belt moving roller 97 and a base end portion on the slider 53 side. The rotating arm 54 is rotatably attached to the housing 11 via a shaft 541 between the acting end portion and the base end portion. A protrusion 542 that fits into a groove 531 of the slider 53 is provided in the base end portion of the rotating arm 54.

The three primary transfer rollers 93 other than that for black are rotatably attached to the tips of the L-shaped support arms 55, respectively. At the other end of each support arm 55, a protrusion 551 arranged in a notch 532 of the slider 53 is provided. Each support arm 55 is rotatably attached to the housing 11 via a shaft 552 between the tip and the other end.

The moving mechanism 51 moves the transfer belt 91 by sliding the slider 53 in the left-right direction shown in the drawing. The moving mechanism 51 moves the transfer belt 91 to the position shown in FIG. 2 in the color mode. In the state where the slider 53 is arranged at the position shown in FIG. 2, the belt moving roller 97 is arranged at the illustrated position to push the transfer belt 91 outward, and the three primary transfer rollers 93 are arranged at the illustrated positions to push the transfer belt 91 against the photosensitive drum 711, 712, and 713. Here, the protrusion 551 provided at the other end of the support arm 55 that supports the three primary transfer rollers 93 is in a non-contact state with the slider 53.

In the monochrome mode, the moving mechanism 51 slides the slider 53 from the position shown in FIG. 2 to the right in the drawing. When the slider 53 is moved to the right in the drawing, the protrusion 542 fitted in the groove 531 of the slider 53 is moved to the right in the drawing, and the rotating arm 54 rotates in the clockwise direction in the drawing around the shaft 541. When the rotating arm 54 rotates in the clockwise direction in the drawing, the acting end portion of the rotating arm 54 does not act on the belt moving roller 97 and the support arm 971 rotates in the counterclockwise direction to cause the belt moving roller 97 to move to the slider 53 side.

When the slider 53 is moved to the right in the drawing, the protrusion 551 is pushed to the right in the drawing by the left edge of the three notches 532 in the slider 53 and the support arm 55 rotates clockwise around the shaft 552. As a result, the three primary transfer rollers 93 move in the direction away from the photosensitive drums 711, 712, and 713, and the transfer belt 91 separates from the photosensitive drums 711, 712, and 713. Here, since the belt pressing roller 98 of the moving mechanism 52 is arranged at the position shown in FIG. 2 to press the transfer belt 91, the transfer belt 91 is not separated from the photosensitive drum 714 for black.

The moving mechanism 52 includes a support arm 56 that supports the primary transfer roller 93 that faces the photosensitive drum 714 for black with the transfer belt 91 interposed therebetween, a support arm 57 that supports the belt pressing roller 98, and an acting arm 58 that acts on the belt pressing roller 98.

The primary transfer roller 93 is rotatably attached to the tip of the swing of the support arm 56. The belt pressing roller 98 is rotatably attached to the tip of the swing of the support arm 57. The base end portions of the two support arms 56 and 57 are attached to be swingable to the housing 11 via the same shaft 59. The two support arms 56 and 57 swing integrally around the shaft 59. In other words, the support arm 56 follows the support arm 57.

The acting arm 58 has an acting end portion that acts on the belt pressing roller 98 and a base end portion that is rotatably attached to the housing 11 via a shaft 581. The belt pressing roller 98 is pushed by the acting end portion of the acting arm 58 to push the transfer belt 91 against the photosensitive drum 714 in a state where the acting arm 58 is rotated to the position shown in FIG. 2.

That is, in the maintenance mode in which the transfer belt 91 is separated from all the photosensitive drums 711, 712, 713, and 714, the transfer belt 91 is moved in the direction away from the photosensitive drum 714 by the moving mechanism 52 from the above-mentioned monochrome mode state. Here, the moving mechanism 52 rotates the acting arm 58 in the counterclockwise direction in FIG. 2 and places the acting arm 58 at a position (not shown) where the acting end portion of the acting arm 58 does not act on the belt pressing roller 98. As a result, the support arm 57 rotates clockwise to move the belt pressing roller 98 upward in the drawing, and the support arm 56 rotates clockwise to move the primary transfer roller 93 in the direction away from the photosensitive drum 714.

As a result, the transfer belt 91 is moved in the direction away from the photosensitive drum 714 and is in a state of being separated from all four photosensitive drums 71. Here, the transfer belt 91 is inclined upward in the drawing from the driven roller 96 toward the tension roller 95 and is in a state of being rotated in the direction away from each photosensitive drum 71 with the downstream side in the traveling direction (the right direction in the drawing) as a fulcrum. Therefore, when the transfer belt 91 is moved to the maintenance position, the distance between the photosensitive drum 714 for black and the transfer belt 91 is the shortest as compared with other colors.

Next, the main circuit configuration of the image forming apparatus 1 will be described.

Figure 3:
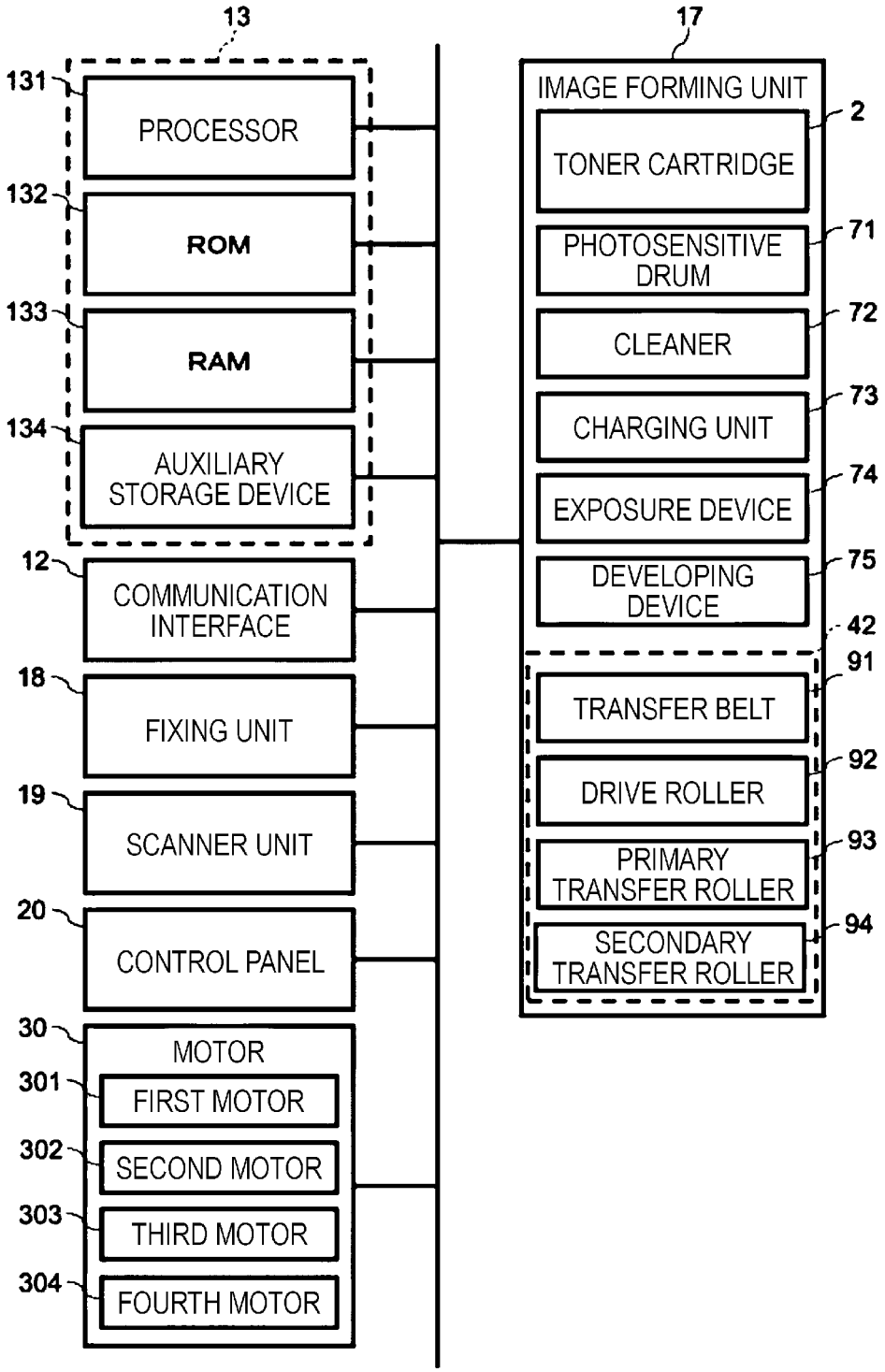
FIG. 3 is a block diagram showing a control system that controls the operation of the image forming apparatus.

As shown in FIG. 3, the image forming apparatus 1 constitutes a circuit by connecting the communication interface 12, the image forming unit 17, the fixing unit 18, the scanner unit 19, the control panel 20, a motor 30, and the like to the system controller 13 by a signal line.

The system controller 13 includes a processor 131, a read only memory (ROM) 132, a random access memory (RAM) 133, and an auxiliary storage device 134. The system controller 13 constitutes a computer by connecting the processor 131, the ROM 132, the RAM 133, and the auxiliary storage device 134 with a signal line.

The processor 131 corresponds to the central part of the computer. The processor 131 controls each unit to realize various functions as the image forming apparatus 1 according to the operating system or the application program. The processor 131 is, for example, a central processing unit (CPU).

The ROM 132 and the RAM 133 correspond to the main memory part of the computer. The ROM 132 is a non-volatile memory area and the RAM 133 is a volatile memory area. The ROM 132 stores an operating system or application program. Further, the ROM 132 stores data necessary for the processor 131 to execute a process for controlling each unit. The RAM 133 is used as a work area in which data is appropriately rewritten by the processor 131. The RAM 133 has, for example, a work area for storing image data.

The auxiliary storage device 134 corresponds to the auxiliary storage part of the computer. As the auxiliary storage device 134, for example, well-known storage devices such as an electric erasable programmable read-only memory (EEPROM), a hard disc drive (HDD), or a solid state drive (SSD) are used alone or in a combination of two or more. The auxiliary storage device 134 stores data used by the processor 131 for performing various processes and data generated by the processes of the processor 131. The auxiliary storage device 134 may store the application program.

The system controller 13 connects the toner cartridge 2, the photosensitive drum 71, the cleaner 72, the charging unit 73, the exposure device 74, the developing device 75, and the transfer unit (transfer belt 91, drive roller 92, and primary transfer roller 93, and the secondary transfer rollers 94) 42 of the image forming unit 17 to each other by signal lines. The system controller 6 controls the toner cartridge 2, the photosensitive drum 71, the cleaner 72, the charging unit 73, the exposure device 74, and the developing device 75 provided for each processing unit 41, and the transfer unit 42 and the fixing unit 18, respectively, thereby forming an image on the print medium P.

The motor 30 includes a first motor 301 used for a drive mechanism for driving the conveyance unit 16, a second motor 302 used for a drive mechanism for rotating the photosensitive drum 71, a third motor 303 used for a drive mechanism for rotating the drive roller 92, and a fourth motor 304 used for the moving mechanisms 51 and 52 for moving the transfer belt 91.

A plurality of second motors 302 are provided to correspond to the photosensitive drums 71 provided in the plurality of processing units 41, respectively. The fourth motor 304 is provided to correspond to each of the moving mechanism 51 and the moving mechanism 52. The motor 30 may include a motor used for a drive mechanism other than the above-mentioned drive mechanisms. The motor 30 is, for example, a brushless motor. The motor 30 may be a brush motor.

When the rotational force of the first motor 301 is transmitted to the conveyance unit 16 as power by the drive mechanism, the print medium P picked up from the sheet tray 14 is conveyed through the sheet feed conveyance path 31 and the sheet discharge conveyance path 32 at a predetermined speed. When the rotational force of the second motor 302 is transmitted to the photosensitive drum 71 as power by the drive mechanism, the photosensitive drum 71 rotates at a predetermined speed. When the rotational force of the third motor 303 is transmitted to the drive roller 92 as power by the drive mechanism, the transfer belt 91 is conveyed at a predetermined speed.

Then, while the one print medium P is being conveyed, the photosensitive drum 71 makes one rotation, and when the transfer belt 91 makes one revolution, an image is formed on the print medium P. That is, the image formation is performed once. Therefore, the image forming speed of the image forming apparatus 1 is determined by the conveying speed of the print medium P, the rotation speed of the photosensitive drum 71, and the conveying speed of the transfer belt 91.

The system controller 13 can adjust the image forming speed of the image forming apparatus 1 by controlling the rotational force of the motor 30. That is, the system controller 13 can adjust the image forming speed of the image forming apparatus 1 by controlling the rotational forces of the first motor 301, the second motor 302, and the third motor 303, respectively.

Next, a contact prevention mechanism 60 for preventing the processing unit 41 from coming into contact with the transfer belt 91 when the processing unit 41 is inserted into and removed from the housing 11 will be described with reference to FIGS. 4 to 9.

For example, when replacing the processing unit 41, the existing old processing unit 41 is pulled out from the housing 11, and a new processing unit 41 is inserted into the housing 11 instead. As described above, the replacement work of the processing unit 41 is performed in a state where the image forming apparatus 1 is switched to the maintenance mode and the transfer belt 91 is separated from the plurality of photosensitive drums 71. The processing unit 41 is prevented from coming into contact with the transfer belt 91 when the processing unit 41 is inserted or removed.

However, in the maintenance mode, when the four primary transfer rollers 93 are separated from the photosensitive drums 711, 712, 713, and 714 and the belt moving roller 97 and the belt pressing roller 98 are retracted upward, the number of members that press the transfer belt 91 outward from the inside is reduced and the tension of the transfer belt 91 is weakened. Therefore, if the transfer belt 91 is elongated or the biasing force applied to the tension roller 95 is weakened over time, the transfer belt 91 may be loosened. Here, even if the transfer belt 91 is moved to the maintenance position, there is a possibility that the transfer belt 91 may not be sufficiently separated from the processing unit 41.

In particular, when the transfer belt 91 is moved to the maintenance position, the distance between the photosensitive drum 714 for black and the primary transfer roller 93 is the shortest as compared with other colors, so that the transfer belt 91 is easy to contact the black photosensitive drum 714. Therefore, the contact prevention mechanism 60 may be provided to correspond to all four processing units 41 as in the present embodiment but the contact prevention mechanism 60 may be provided only in the processing unit 41 for black.

If the processing unit 41 is inserted into and removed from the housing 11 while the transfer belt 91 is still in contact with the processing unit 41, the processing unit 41 may be in sliding contact with the transfer belt 91. Since the processing unit 41 is manually inserted into and removed from the housing 11, it is not easy to move the processing unit 41 horizontally with respect to the housing 11 in a straight line. It is not easy to move the processing unit 41 straight due to a manufacturing error. Therefore, when inserting or removing the processing unit 41 into and from the housing 11, it is desirable to ensure that the transfer belt 91 is separated from the processing unit 41 regardless of the posture of the processing unit 41.

In the image forming apparatus 1 of the present embodiment, the contact prevention mechanism 60 is provided so that the processing unit 41 can be inserted into and removed from the housing 11 without the processing unit 41 coming into contact with the transfer belt 91 even when the transfer belt 91 is loosened over time in a state where the transfer belt 91 is moved to the maintenance position. In the present embodiment, a plurality of contact prevention mechanisms 60 (four in the present embodiment) are provided corresponding to the processing units 41 of a color.

The contact prevention mechanism 60 may be provided on both the front side and the rear side of each processing unit 41. In the present embodiment, the contact prevention mechanism 60 is provided only on the front side of each processing unit 41. If the contact prevention mechanism 60 is provided on the front side, it is possible to prevent a problem that the tip of the processing unit 41 in the insertion direction comes into contact with the transfer belt 91 when the processing unit 41 is inserted into the housing 11, which is more effective. Since the plurality of contact prevention mechanisms 60 have substantially the same structure, here, the contact prevention mechanism 60 provided on the front side of the processing unit 41 for black will be mainly described and the description of the mechanisms for other colors will be omitted.

Figure 4:
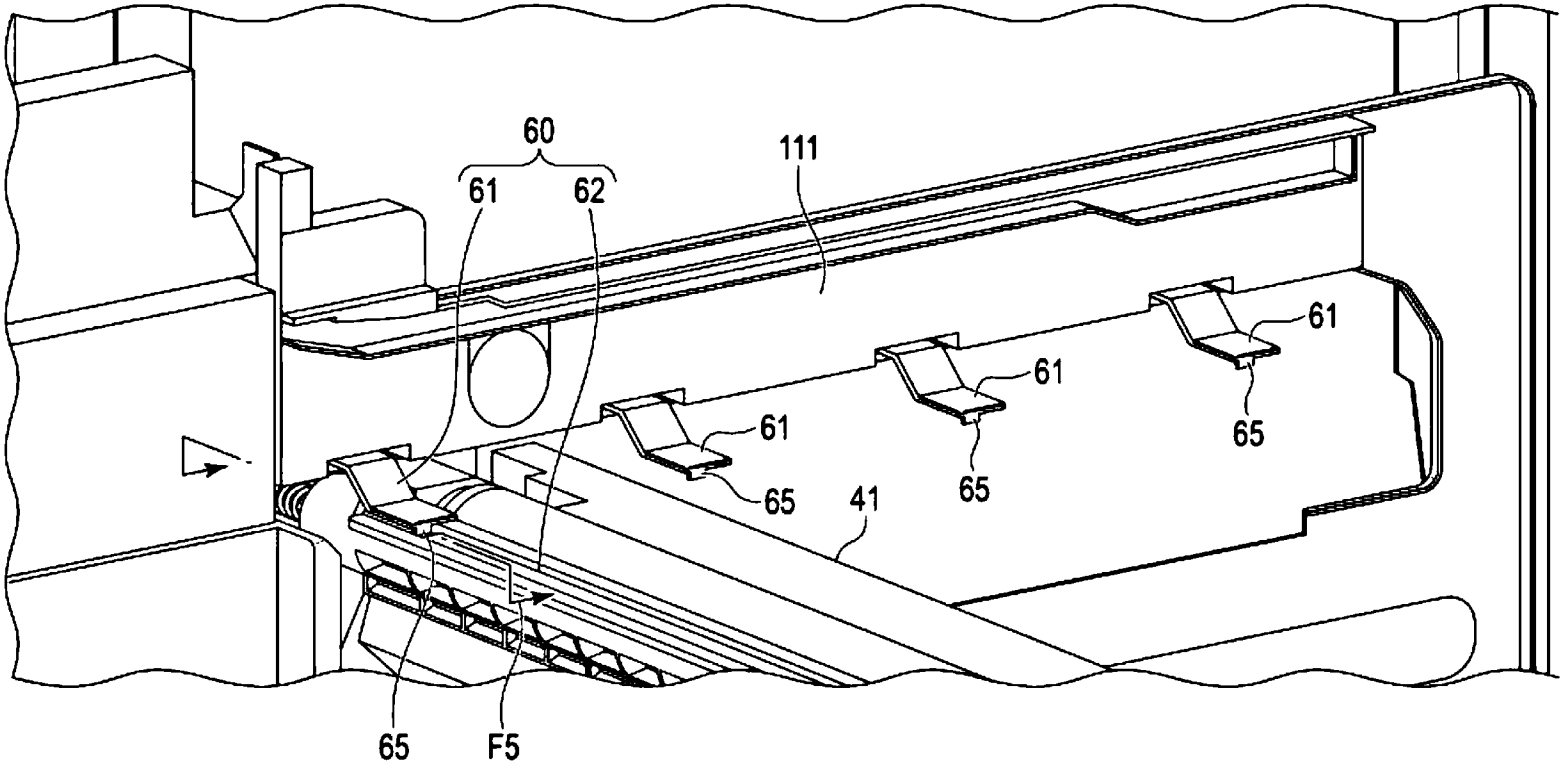
FIG. 4 is a perspective view of a contact prevention mechanism of the image forming apparatus as viewed from the inside of the housing.

As shown in FIG. 4, the contact prevention mechanism 60 includes a push-up member 61 (pressing member) rotatably attached to a frame 111 of the housing 11, and a rib 62 provided in the processing unit 41. The frame 111 is a portion forming a part of the housing 11 facing the front side of the transfer unit 42 and extends in the left-right direction. In FIG. 4, the transfer unit 42 is not shown and the three processing units 41 other than the processing unit 41 for black are not shown. As for the contact prevention mechanism 60 other than the one for black, only the push-up member 61 is shown.

Figure 5:
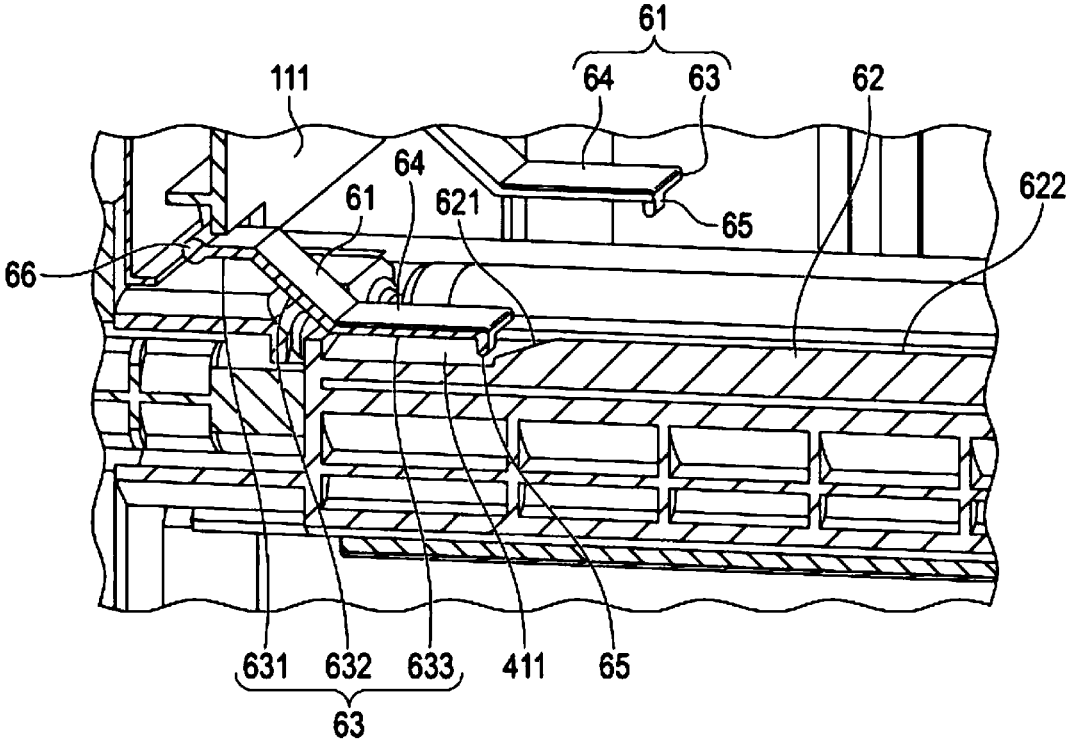
FIG. 5 is a cross-sectional view of the structure of the main part of FIG. 4 as viewed along the arrow F5.

As shown in FIG. 5, the push-up member 61 includes a plate 63 in which a substantially rectangular plate-like body is bent in a substantially Z shape at two locations and a rectangular protective sheet 64 (contacting portion) attached to a part of the surface of the plate 63. The plate 63 integrally has a protrusion 65 (contacted portion) that is in sliding contact with the rib 62 of the processing unit 41 on the lower surface side near the tip of the rotation. The plurality of push-up members 61 are arranged side by side in the traveling direction of the transfer belt 91.

The material of the plate 63 and the protrusion 65 is preferably a material having a low coefficient of dynamic friction with respect to the rib 62 of the processing unit 41 and various materials such as metal and resin can be used. Since the protective sheet 64 is provided on the surface portion of the plate 63 in which the push-up member 61 contacts the transfer belt 91, the material thereof is desirably a soft material that does not easily damage the transfer belt 91 when the protective sheet comes into contact with the transfer belt 91.

The push-up member 61 is freely rotatably attached to the frame 111 via a shaft 66. The shaft 66 extends in the longitudinal direction of the frame 111, that is, in the left-right direction. The shaft 66 is provided at the base end portion of the plate 63, which is the center of rotation of the push-up member 61.

The frame 111 is provided with a stopper (not shown) for holding the push-up member 61 in the posture shown in the drawing. The stopper locks the push-up member 61, which intends to rotate in the clockwise direction in the drawing by its own weight around the shaft 66, in the posture shown in the drawing. That is, the push-up member 61 cannot rotate in the clockwise direction from the position shown in the drawing and can rotate in the counterclockwise direction. The push-up member 61 may be biased in the clockwise direction in the drawing by a spring (not shown) or the like.

The push-up member 61 extends from the base end portion provided with the shaft 66 toward the rear side of the image forming apparatus 1. The plate 63 of the push-up member 61 includes a first portion 631 on the base end side having the shaft 66, a third portion 633 on the distal end side having the protrusion 65, and a second portion 632 inclined to connect the first portion 631 and the third portion 633. The rear-side end portion of the first portion 631 is above and on the front-side end portion of the third portion 633. The second portion 632 is inclined downward from the rear-side end portion of the first portion 631 toward the front-side end portion of the third portion 633. The first portion 631 and the third portion 633 are arranged substantially horizontally with the processing unit 41 inserted into the housing 11 (the state shown in FIGS. 4 and 5).

The rib 62 extends in the longitudinal direction of the processing unit 41, that is, in the front-rear direction of the processing unit 41. The rib 62 is integrally projected above the cleaner 72 of the processing unit 41 on the upper surface of a housing 411 of the processing unit 41. The rib 62 is arranged at a position in sliding contact with the protrusion 65 of the push-up member 61 when the processing unit 41 is inserted into and removed from the housing 11.

An inclined slide surface 621 is provided at the front-side end portion of the rib 62. On the rear side of the slide surface 621 of the rib 62, an upper end surface 622 is provided continuously with the slide surface 621. The slide surface 621 and the upper end surface 622 are provided on the surface of the rib 62. The slide surface 621 is inclined downward from the front-side end portion of the upper end surface 622 of the rib 62 toward the upper surface of the housing 411.

The slide surface 621 is provided at a position slightly distant from the rear side from the protrusion 65 of the push-up member 61 so that the rib 62 is not in contact with the push-up member 61 in a state where the processing unit 41 is inserted into the housing 11 (the state shown in FIG. 5). The upper end surface 622 of the rib 62 is a flat surface that is arranged substantially horizontally with the processing unit 41 inserted in the housing 11.

Figure 6:
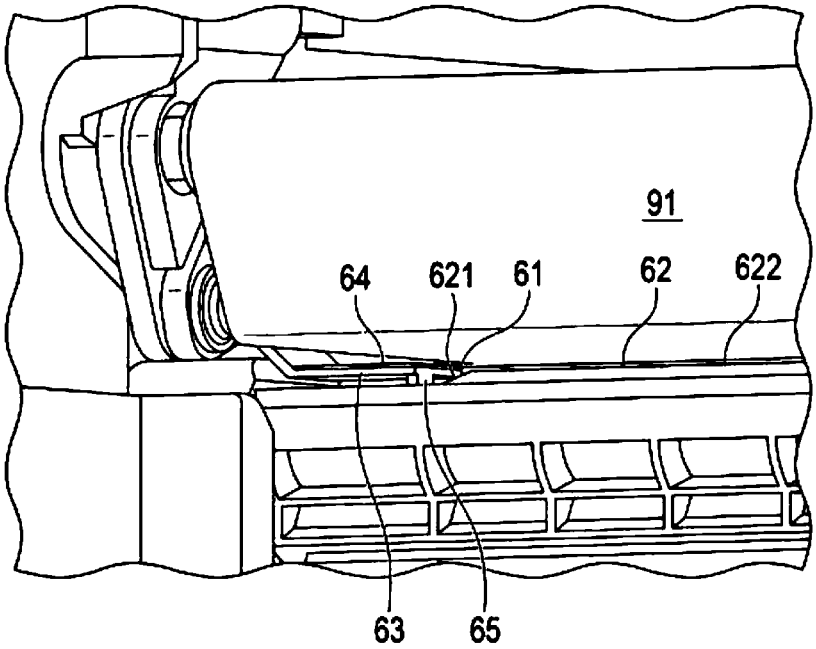
FIG. 6 is a perspective view for illustrating the relationship between the push-up member and the transfer belt of FIG. 5.

As shown in FIG. 6, when the processing unit 41 is inserted into the housing 11, the push-up member 61 is in a non-contact state with respect to the transfer belt 91 of the transfer unit 42. That is, there is a gap between the protective sheet 64 attached to the upper surface of the third portion 633 of the push-up member 61 and the transfer belt 91. From a different point of view, the rib 62 has a length that makes the processing unit 41 non-contact with the push-up member 61 when the processing unit 41 is inserted into the housing 11.

Figure 7:
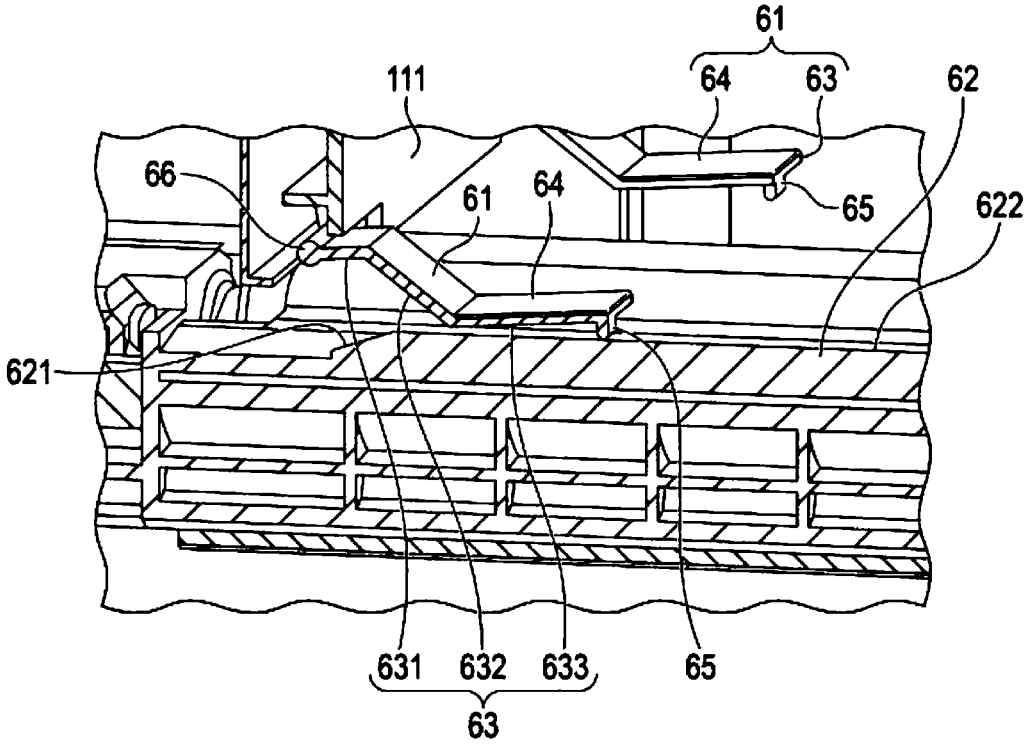
FIG. 7 is a cross-sectional view showing a state of the contact prevention mechanism when the processing unit of FIG. 5 is pulled out from the housing.
Figure 8:
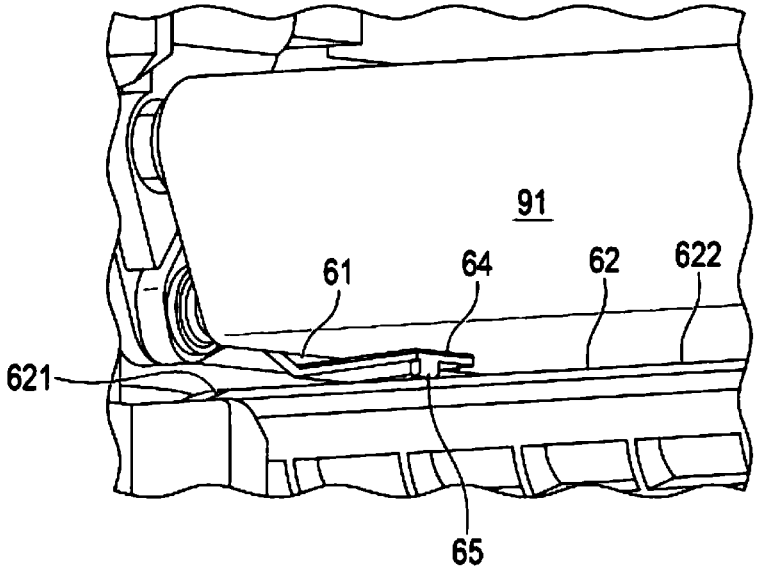
FIG. 8 is a perspective view for illustrating the relationship between the push-up member of FIG. 7 and the transfer belt.

When the processing unit 41 is moved to the front side and the operation of pulling out the processing unit 41 from the housing 11 is started from the state shown in FIGS. 4 to 6, the protrusion 65 of the push-up member 61 rides on the upper end surface 622 of the rib 62 as shown in FIGS. 7 and 8 and the push-up member 61 rotates slightly in the counterclockwise direction about the shaft 66. First, the protrusion 65 of the push-up member 61 contacts and slides into contact with the slide surface 621 of the rib 62, and the protrusion 65 is gradually pushed upward while moving along the slide surface 621. Then, after the protrusion 65 comes into contact with the upper end surface 622 of the rib 62, the rotation of the push-up member 61 is stopped and the posture of the push-up member 61 is maintained.

When the push-up member 61 rotates, the protective sheet 64 comes into contact with the transfer belt 91 and the third portion 633 of the push-up member 61 partially pushes up the transfer belt 91, as shown in FIGS. 7 and 8. The amount of push-up at the end portion of the transfer belt 91 by the push-up member 61 can be set to the desired amount by changing the protrusion height of the protrusion 65 of the push-up member 61. The protective sheet 64 of the push-up member 61 partially contacts the portion near the front side edge of the transfer belt 91 and the front-side end portion of the transfer belt 91 is partially pushed up.

As described above, when the processing unit 41 is pulled out from the housing 11, the front-side end portion of the transfer belt 91 near the processing unit 41 is pushed up in the direction away from the processing unit 41, and thus it is possible to prevent the processing unit 41 from coming into contact with at least the front-side end portion of the transfer belt 91.

Figure 9:
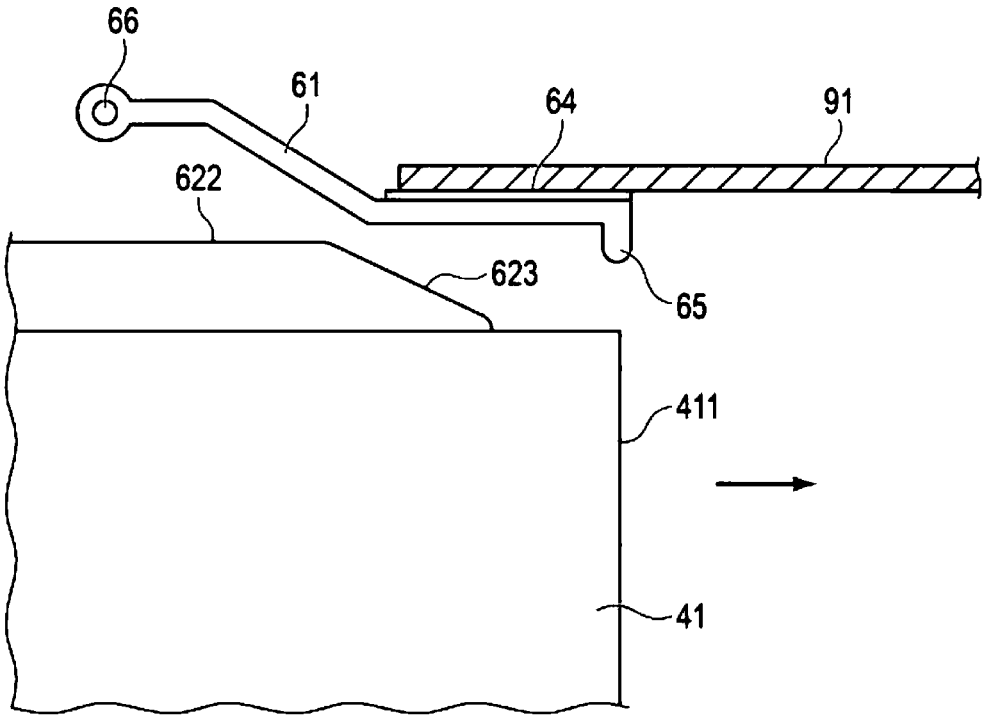
FIG. 9 is an operation explanatory diagram for illustrating the operation of the contact prevention mechanism when the processing unit is inserted into the housing.
Figure 10:
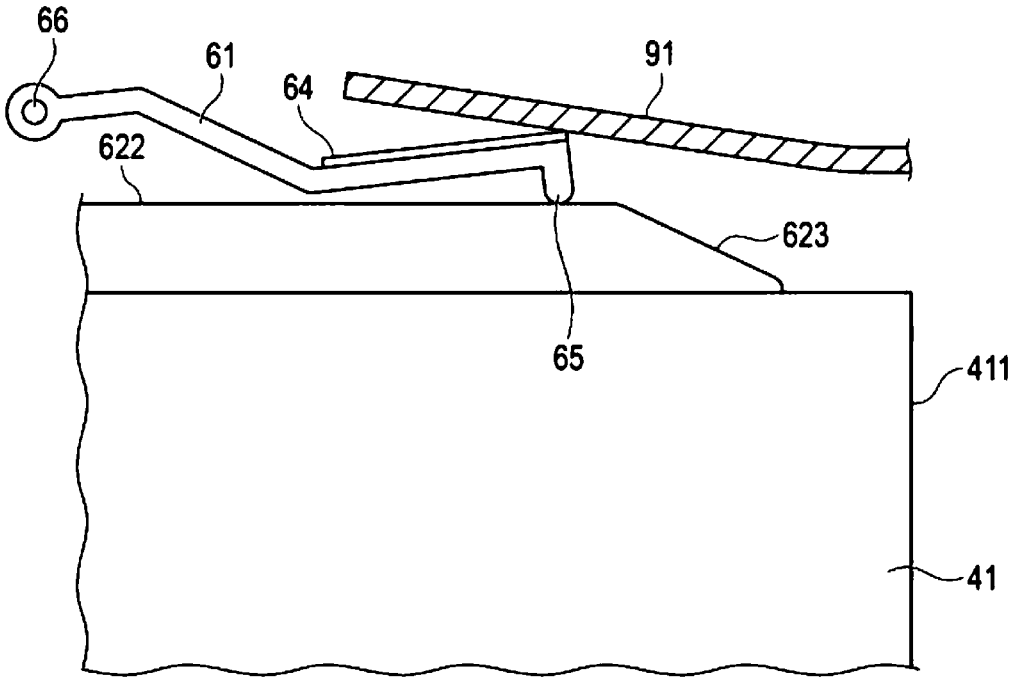
FIG. 10 is an operation explanatory diagram for illustrating the operation of the contact prevention mechanism when the processing unit is inserted into the housing.

As shown in FIGS. 9 and 10, a slide surface 623 is provided at the rear-side end portion of the rib 62 provided on the upper surface of the housing 411 of the processing unit 41, similarly to the front-side end portion. The slide surface 623 is continuous with the upper end surface 622 of the rib 62 and is inclined downward from the rear-side end portion of the upper end surface 622 of the rib 62 toward the upper surface of the housing 411. The slide surface 623 is provided at a position where the slide surface 623 first contacts the protrusion 65 of the push-up member 61 when the processing unit 41 is started to be inserted into the housing 11.

As shown by an arrow in FIG. 9, when the processing unit 41 is inserted into the housing 11, the tip of the protrusion 65 of the push-up member 61 first comes into contact with the slide surface 623 of the rib 62. When the processing unit 41 is further inserted, the protrusion 65 receives a reaction force from the slide surface 623 and is pushed upward while sliding in contact with the slide surface. As a result, the push-up member 61 is rotated in the counterclockwise direction in the drawing. Then, the protective sheet 64 of the push-up member 61 comes into contact with the lower surface of the transfer belt 91, and the portion near the front side edge of the transfer belt 91 is slightly lifted upward as shown in FIG. 10.

As such, by inserting the processing unit 41 into the housing 11, the front-side end portion of the transfer belt 91 is lifted in the vicinity of the photosensitive drum 71 in the direction away from the processing unit 41, whereby it is possible to prevent the processing unit 41 from contacting the transfer belt 91. For example, even when the transfer belt 91 is loose, it is possible to prevent the processing unit 41 from colliding with the front side edge of the transfer belt 91.

When the tip of the protrusion 65 comes into contact with the upper end surface 622 of the rib 62 due to the insertion of the processing unit 41, the rotation of the push-up member 61 is stopped and the posture shown in FIG. 10 is maintained. The state is maintained until the processing unit 41 is inserted into the housing 11. Then, when the processing unit 41 is completely inserted into the housing 11, as shown in FIGS. 4 and 5, the protrusion 65 of the push-up member 61 is disengaged from the rib 62 and the push-up member 61 becomes a non-contact state with respect to the transfer belt 91.

As described above, according to the present embodiment, the push-up member 61 is attached to the frame 111 of the housing 11 corresponding to the processing unit 41 of each color, and when the processing unit 41 of each color is inserted into and removed from the housing 11, the protrusion 65 of the push-up member 61 is in sliding contact with a part (rib 62) of the processing unit 41. Therefore, according to the present embodiment, it is possible to prevent the processing unit 41 from coming into contact with the transfer belt 91 at the time of replacement work only by providing the contact prevention mechanism 60 (pushing member 61 and rib 62) having a simple structure.

While certain embodiments have been described, this embodiment has been presented by way of example only, and is not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

For example, in the above-described embodiment, the push-up member 61 of the contact prevention mechanism 60 has a shape obtained by bending a rectangular plate-like body into a substantially Z shape, but the shape of the push-up member 61 is not limited thereto and may be any shape. The push-up member 61 may be, for example, a spring member whose one end is fixed to the frame 111 and does not necessarily have to be rotatably provided with respect to the frame 111. The push-up member 61 may be any as long as the push-up member can push the transfer belt 91 away from the processing unit 41 by the reaction force received from the rib 62 when the push-up member comes into contact with the rib 62.

For example, the shape of the push-up member 61 is not limited to the shapes shown in FIGS. 4 to 10. For example, the first portion 631 may not be provided between the shaft 66 of the push-up member 61 and the second portion 632. That is, the shaft 66 and the second portion 632 may be continuous.

In the push-up member 61 described above, as shown in FIG. 10, for example, the distance between the protrusion 65 (force point) that receives the reaction force from the rib 62 and the shaft 66 (fulcrum) that is the center of rotation is substantially the same as the distance between the protective sheet 64 (near the tip) where the push-up member 61 contacts the transfer belt 91 and the shaft 66. However, the distance between the protrusion 65 and the shaft 66 or the distance between the portion in contact with the transfer belt 91 and the shaft 66 may be changed to a desired ratio.

The protruding height of the protrusion 65 of the push-up member 61 can be variously selected. For example, the height of the protrusion 65 of the push-up member 61 may be different depending on the color of the processing unit 41 provided with the contact prevention mechanism 60. Here, as described above, since there is a higher risk that the processing unit 41 for black will come into contact with the transfer belt 91 as compared with other colors, the protrusion 65 of the push-up member 61 provided corresponding to the black processing unit 41 may be the highest.

In the above-described embodiment, the contact prevention mechanism 60 having a structure in which the protrusion 65 of the push-up member 61 attached to the frame 111 is brought into contact with the rib 62 provided in the housing 411 of the processing unit 41 is used, but instead of the configuration necessarily using the rib 62, the end portion of the transfer belt 91 may be lifted by sliding contact with the protrusion 65 of the push-up member 61 against a part of the housing 411 of the processing unit 41.

The slide surfaces 621 and 623 provided at the end portions of the rib 62 along the insertion and removal direction of the processing unit 41 are not necessarily limited to the above-mentioned shapes but may have a dome-shaped curved shape or the like. Alternatively, the slide surfaces 621 and 623 of the rib 62 may not be provided.

What is claimed is:

1. An image forming apparatus, comprising:

an apparatus main body including a transfer belt wound around a plurality of rollers in an endless manner;

a processing component configured to be inserted into and removed from the apparatus main body, the processing component including a photosensitive drum facing the transfer belt in a state of being inserted into the apparatus main body, and configured to form an image on the surface of the photosensitive drum; and a pressing member provided on the apparatus main body and including a contacted portion that comes into contact with the processing component when the processing component is inserted into and removed from the apparatus main body, and a contacting portion that comes into contact with the transfer belt due to contact with the processing component to push the transfer belt in a direction away from the processing component.

2. The image forming apparatus according to claim 1, wherein the pressing member is arranged in a non-contact state with respect to the transfer belt when the contacted portion is not in contact with the processing component.

3. The image forming apparatus according to claim 1, wherein the processing component includes a housing that rotatably supports the photosensitive drum, and the housing includes a rib extending in an insertion and removal direction of the processing component at a position where the processing component comes into contact with the contacted portion of the pressing member when the processing component is inserted into and removed from the apparatus main body.

4. The image forming apparatus according to claim 3, wherein the rib is in a non-contact state with the pressing member when the processing component is inserted into the apparatus main body.

5. The image forming apparatus according to claim 1, wherein the processing component is configured to be inserted into and removed from the front side of the apparatus main body with respect to the apparatus main body, and the pressing member is provided on the front side of the apparatus main body.

6. The image forming apparatus according to claim 1, further comprising:

a contact prevention mechanism for preventing the processing component from contacting the transfer belt when the processing component is inserted into and removed from the apparatus main body.

7. The image forming apparatus according to claim 6, wherein the contact prevention mechanism includes a push-up member rotatably attached to a frame of the apparatus main body, and a rib provided in the processing component.

8. The image forming apparatus according to claim 1, wherein the processing component is configured to avoid contacting the transfer belt when the processing component is inserted into and removed from the apparatus main body.

9. The image forming apparatus according to claim 1, wherein the processing component comprises a cylindrical drum and a photosensitive layer.

10. An image forming apparatus, comprising:

an apparatus main body including a transfer belt wound around a plurality of rollers in an endless manner;

a plurality of processing components provided so that the plurality of processing components are separable from each other along a traveling direction of the transfer belt and configured to be inserted into and removed from the apparatus main body, each of the plurality of processing components including a photosensitive drum facing the transfer belt in a state of being inserted into the apparatus main body, and configured to form an image on a surface of the photosensitive drum;

a moving mechanism that rotates the transfer belt with the downstream side in the traveling direction as a fulcrum to separate the transfer belt from the plurality of photosensitive drums;

a pressing member provided on the apparatus main body corresponding to a first processing component on the most downstream side in the traveling direction of the transfer belt and including a contacted portion that comes into contact with the first processing component when the first processing unit is inserted into and removed from the apparatus main body and a contacting portion that comes into contact with the transfer belt due to contact with the first processing component to push the transfer belt in a direction away from the first processing component.

11. The image forming apparatus according to claim 10, wherein the pressing member is arranged in a non-contact state with respect to the transfer belt when the contacted portion is not in contact with the first processing component.

12. The image forming apparatus according to claim 10, wherein the first processing component includes a housing that rotatably supports the first photosensitive drum, and the housing includes a rib extending in an insertion and removal direction of the first processing component at a position where the first pressing member comes into contact with the contacted portion of the pressing member when the first processing component is inserted into and removed from the apparatus main body.

13. The image forming apparatus according to claim 12, wherein the rib is in a non-contact state with the pressing member in a state where the first processing component is inserted into the apparatus main body.

14. The image forming apparatus according to claim 10, wherein the first processing component configured to be inserted into and removed from the front side of the apparatus main body with respect to the apparatus main body, and the pressing member is provided on the front side of the apparatus main body.

15. The image forming apparatus according to claim 10, comprising four processing components.

16. The image forming apparatus according to claim 15, wherein the four processing components comprise a black toner processing component, a yellow toner processing component, a cyan toner processing component, and a magenta toner processing component.

17. The image forming apparatus according to claim 10, wherein the plurality of processing components comprises a different processing component for each type of toner used by the image forming apparatus.

18. The image forming apparatus according to claim 10, further comprising:

a plurality of contact prevention mechanisms for preventing the plurality of processing components from contacting the transfer belt when the plurality of processing components are inserted into and removed from the apparatus main body.

19. The image forming apparatus according to claim 18, wherein the plurality of contact prevention mechanisms include a push-up member rotatably attached to a frame of the apparatus main body, and a rib provided in each of the processing components.

20. The image forming apparatus according to claim 10, wherein the plurality of processing components are configured to avoid contacting the transfer belt when the plurality of processing components are inserted into and removed from the apparatus main body.

* * * * *